US011083348B2

(12) United States Patent
Sulik et al.

(10) Patent No.: US 11,083,348 B2
(45) Date of Patent: Aug. 10, 2021

(54) ROLLED WEB MATERIAL DISPENSER MATERIAL LOCKOUT SYSTEMS

(71) Applicant: San Jamar, Inc., Elkhorn, WI (US)

(72) Inventors: Jarod Sulik, Elkhorn, WI (US); Bernie Ziebart, Pewaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 147 days.

(21) Appl. No.: 16/368,191

(22) Filed: Mar. 28, 2019

(65) Prior Publication Data

US 2020/0305655 A1 Oct. 1, 2020

(51) Int. Cl.
*A47K 10/36* (2006.01)

(52) U.S. Cl.
CPC ..... *A47K 10/36* (2013.01); *A47K 2010/3675* (2013.01)

(58) Field of Classification Search
CPC ..... B65H 75/185
USPC ..... 242/599.1, 599.4, 596.7, 597.5, 597.6
See application file for complete search history.

(56) References Cited

U.S. PATENT DOCUMENTS

| | | | | |
|---|---|---|---|---|
| 1,716,812 | A | 6/1929 | Ball | |
| 3,552,669 | A | 1/1971 | Earnest | |
| 4,108,513 | A | 8/1978 | Lander | |
| 4,557,426 | A | 12/1985 | Siciliano | |
| 5,310,129 | A | 5/1994 | Whittington et al. | |
| 5,636,812 | A | 6/1997 | Conner et al. | |
| 6,390,410 | B1 * | 5/2002 | LaCount | A47K 10/40 242/571.5 |
| 6,491,251 | B1 | 12/2002 | Stanland et al. | |
| 6,648,267 | B2 | 11/2003 | Stanland et al. | |
| 6,874,958 | B1 * | 4/2005 | Panebianco | B41J 15/02 242/358.1 |
| 7,014,140 | B2 | 3/2006 | Elliott et al. | |
| 7,044,419 | B2 | 5/2006 | Moore | |
| 7,114,676 | B2 | 10/2006 | Elliott et al. | |
| D543,402 | S | 5/2007 | Goeking et al. | |
| D543,745 | S | 6/2007 | Goeking et al. | |
| D556,482 | S | 12/2007 | Goeking et al. | |
| 7,461,810 | B2 | 12/2008 | Goeking et al. | |
| 8,356,767 | B2 | 1/2013 | Formon et al. | |
| 8,479,957 | B2 | 7/2013 | Ophardt | |

(Continued)

FOREIGN PATENT DOCUMENTS

EP 1064876 B1 3/2005

*Primary Examiner* — William A. Rivera
(74) *Attorney, Agent, or Firm* — Boyle Fredrickson S.C.

(57) ABSTRACT

A lockout system that is configured to limit use of a rolled web material dispenser assembly to dispense only authorized rolls of web material. The lockout system includes respective first and second mating registration elements that removeably cooperate with one another and provide a rotational cooperation therebetween when engaged with one another. One of the registration elements is non-removeably associated with each authorized roll of web material and the mating registration element is associated with the rolled web material dispenser assembly. The first registration element is supported by the bore of discrete authorized rolls of web material. The corresponding and mating second registration element is supported by the roll dispenser. Mating of the first and second registration elements provides a rotatable linkage that facilitates rotation of the roll relative to the dispenser assembly during the dispense activity.

21 Claims, 17 Drawing Sheets

(56) References Cited

U.S. PATENT DOCUMENTS

| | | | | |
|---|---|---|---|---|
| 2001/0054667 | A1* | 12/2001 | Komatsu | B65H 75/08 242/596.1 |
| 2007/0063092 | A1* | 3/2007 | Zevin | B65H 16/06 242/571.5 |
| 2009/0283623 | A1* | 11/2009 | Yamada | B41J 15/02 242/596.7 |
| 2012/0138723 | A1* | 6/2012 | Lewis | A47K 10/38 242/160.4 |
| 2015/0150422 | A1* | 6/2015 | Ochoa, Sr. | A47K 10/16 242/596.7 |
| 2015/0305578 | A1* | 10/2015 | Keily | A47K 10/38 242/419.9 |
| 2020/0307949 | A1* | 10/2020 | Sulik | A47K 10/3845 |

* cited by examiner

ROLLED WEB MATERIAL DISPENSER MATERIAL LOCKOUT SYSTEMS

BACKGROUND OF THE INVENTION

The present invention is generally directed to a dispenser product lockout system and, more particularly, to a rolled web material dispenser having a mechanical lockout feature that prevents use of a dispenser assembly for dispensing rolled web material that is acquired from non-approved or unauthorized sources.

Conventional rolled web material dispensers for use in dispensing hand towel and toilet tissue material or the like often advance the web material from a roll as the roll rotates about a spindle, bobbin, or hub located within the dispenser. Upon depletion of the rolled web material, the dispenser housing is opened, and a replacement roll of web material is then placed within the dispenser. Conventional rolls of web materials may be coreless or include a hollow core for receiving a generic or common spindle that extends laterally through the core and whose opposing ends are supported by the dispenser housing. When provided in coreless configuration, the axially opposing end located portions of the web material may be pinched between opposing fingers or compression assemblies that collectively define the rotational axis of the roll of web material relative to the dispenser.

Whether provided in a cored or coreless configuration of rolled of web material, conventional paper roll dispensers are not commonly configured to selectively dispense only a particular type, style, or roll of web material or a roll of web material from a particular manufacturer. Accordingly, it is possible for a size discrepancy or mismatch to occur between the dispenser and the roll of web material, thereby inhibiting the proper dispensing of the web material.

Shortcomings in the dispense operation can sometimes be incorrectly attributed to subpar operability of the dispenser assembly rather than being attributable to deviations in the manufacture of the discrete rolled web material and/or use of rolled web materials that are ill-suited for being dispensed from a given dispenser assembly or produced with subpar manufacturing practices. Improper or less than efficient operation of the rolled web material dispenser to dispense rolled web material in a repeatable manner, but attributable to improper loading or use of a dispenser with web material not properly configured for cooperation with a discrete dispenser assembly, may reflect adversely on the manufacturer of the dispenser rather the establishment or service provider associated with maintaining operation of the discrete dispenser assemblies once deployed and ensuring that only suitable rolled web materials are associated therewith. Accordingly, there is a need for a roll dispenser that is constructed to limit use of the dispenser assembly to dispense only desired rolled web materials and thereby inhibit use of the dispenser assembly to dispense rolls of web material that have not be authorized to be dispensed from the corresponding dispenser.

Further, a need exists for a mechanical lockout feature that prevents necessary positioning or support of unauthorized rolls of web material relative to a given dispenser. In such a lockout system, in the event that there is an inconsistency between a registration component associated with a core of the roll and a mating registration portion associated with the spindle of the dispenser, the roll of material will not be accepted into the dispenser in an operable manner thereby inhibiting use and/or proper dispensing of an unauthorized roll of web material.

A further need exists for a lockout roll dispensing system that is relatively inexpensive to manufacturer, produce, and maintain in a useable condition, inhibits use of unauthorized rolls of web materials, and solves other problems associated with existing configurations. A still further need exists for a dispenser assembly roll of web material lockout system that can be quickly and conveniently implemented into existing or previously deployed dispenser assemblies and which includes separable elements that can be configured to designate rolls of web material as authorized to be dispensed with dispenser assemblies that have been reconfigured to include the lockout system.

SUMMARY OF THE INVENTION

The present invention discloses a roll of web material lockout system that resolves one or more of the shortcomings disclosed above.

One aspect of the present invention discloses a web material roll lockout system for use in a dispenser that includes a core insert configured to be disposed within a core of the web material roll, where the core insert comprising a first registration element. The system further includes an adapter configured to rotatably receive the core insert, where the adapter comprises a second registration element mating with the first registration element when the core insert is rotatably received at the adapter. A linkage configured to support the web material roll is formed in the system by the mating of the first and second registration elements.

Another aspect of the present invention discloses the first registration element formed of a plurality of spaced apart projections and the second registration element formed of a corresponding plurality of spaced apart slots that have an outer perimeter that corresponds to the shape of the projections.

Another aspect of the present invention discloses that the first registration element consists of a plurality of radially located flexible space apart projections extended generally perpendicular to an axis of rotation of the core insert that define a space therebetween, and the second registration element consists of a hub configured to snap-fit between the flexible spaced apart projections.

Still another aspect of the present invention discloses at least one projection extending forwardly of a front surface of the adapter and configured to frictionally engage a lateral edge of the web material roll as to inhibit or break rotational movement thereof.

Still another aspect of the present invention discloses the adapter including a seat rotatably fixed to the dispenser and a rotatable disc disposed between the seat and the core insert, and wherein the second registration element is disposed within the rotatable disc.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
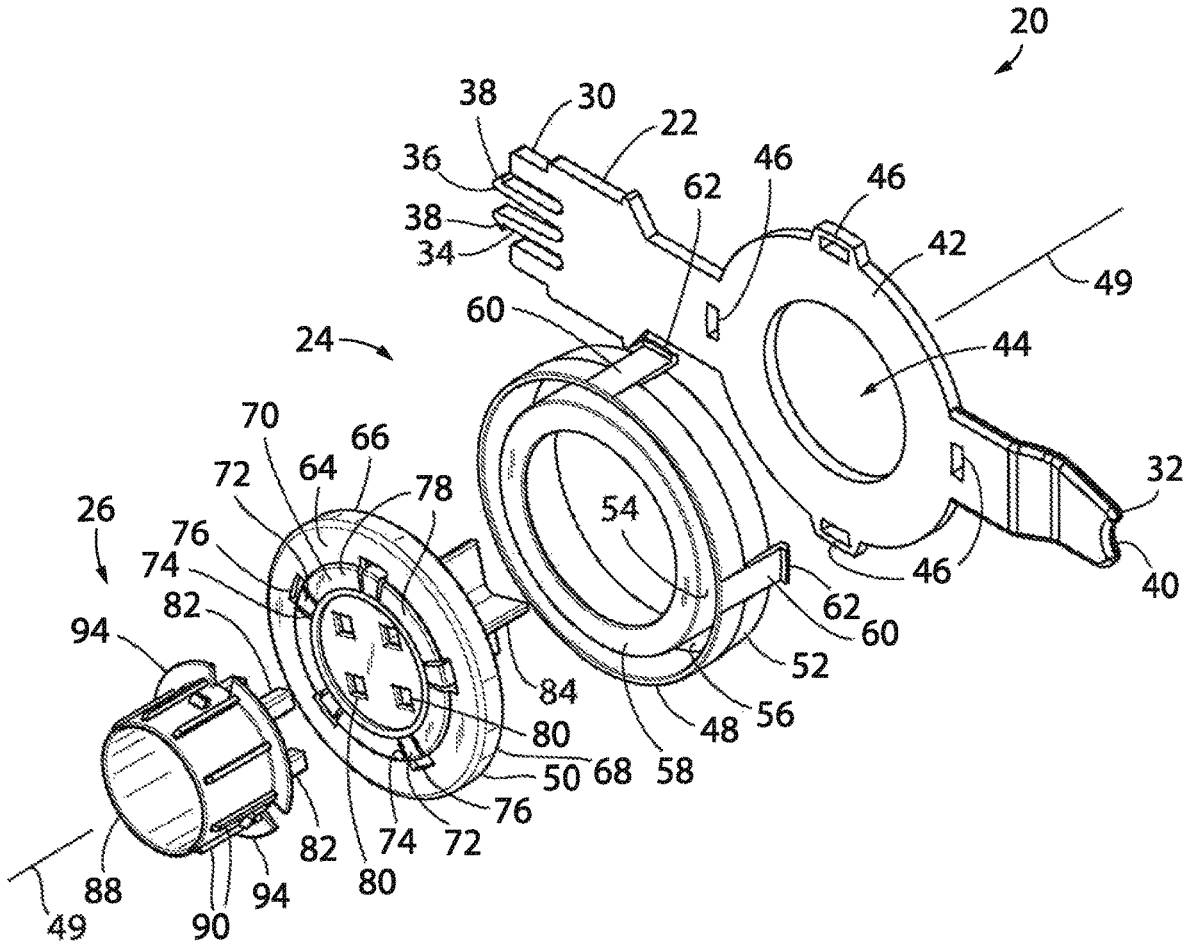
FIG. 1 is an exploded perspective view of a rolled web material lockout system for use in a rolled web material dispenser and according to one embodiment of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

The various features and advantageous details of the subject matter disclosed herein are explained more fully with reference to the non-limiting embodiments described in detail in the following description.

Illustrative embodiments of rolled web material lockout systems in accordance with various aspects of the present invention are shown in FIG. 1 through FIG. 17. FIGS. 1-8, and initially FIG. 1, shows a rolled material lockout system 20 according to a first embodiment of the invention and constructed to cooperate with a rolled web material dispenser as disclosed further below with respect to FIG. 17. Roll lockout system 20 includes a hub or roll support arm 22, an adapter 24 and a core insert 26. As disclosed further below with respect to FIGS. 8 and 17, roll support arm 22 is preferably constructed to snap-fittingly cooperate with a housing or enclosure of a dispenser or dispenser assembly 28 configured to dispense rolled web material in an unwinding or unrolling manner. The roll support arm 22 extends in a generally linear manner along a length from a first end 30 to an opposing second end 32. The first end 30 of the roll support arm 22 includes a first and preferably a second resilient catch arm 34, 36, which each contains a respective opposing barb 38 formed proximate an end thereof and that is configured to releasably engage a receiving slot formed in the dispenser 28. Each support arm 22 is preferably constructed to cooperate with dispenser 28 in a snap-fit manner. The opposing second end 32 of the roll support arm 22 has an arcuate depression 40 that is configured to allow a user to selectively deflect the respective support arm 22 in a generally outward lateral direction relative to one another to aid in the association of an authorized roll with dispenser 28 or the removal of the core of spent or consumed roll therefrom. It is further appreciated that opposing second end 32 could be configured to cooperate with an interior facing surface of a cover of dispenser 28 when the cover is oriented in a closed position. Such a consideration allows the weight of the rolled web material to be distributed over both ends 30, 32 of each respective roll support arm 22. Alternatively, it is appreciated that support arms 22 are constructed to support the opposing ends of a discrete roll of web material in a cantilevered fashion relative to end 30 and the housing of dispenser 28 as disclosed further below with respect to FIG. 17.

An adapter receiving area 42 is disposed along a front or roll facing surface of the length of the roll support arm 22 between the first and second ends 30, 32. As shown in FIG. 1, the adapter receiving area 42 in one embodiment of the present invention is generally circular having a hollow center or void 44 therein. However, it should be understood that the present invention is not so limited and that any alternative configuration of the adapter receiving area 42 is considered within the scope of the present invention. Still referring to FIG. 1, the adapter receiving area 42 of support arm 22 includes a plurality of receiving slots 46 that are annularly disposed proximate the perimeter of the adapter receiving area 42 for receiving and mating to the adapter 24 as described further below.

Turning now to the adapter 24, and still referring to FIG. 1, the adapter 24 is formed of a seat 48 and a mating disc 50, wherein the disc 50 is configured to rotate along its central axis 49 within the seat 48, which is configured to remain in a fixed position relative to the roll support arm 22. It is appreciated that axis 49 defines the longitudinal or axial axis of rotation of a roll of web material associated with the dispenser assembly. Although adapter 24 is defined by seat 48 and disc 50, it is appreciated that adapter 24 can formed by other numbers of cooperating members or formed as a single integral structure as disclosed further below with respect to the embodiment disclosed in FIGS. 9-16.

Still referring to FIG. 1, the seat 48, which is generally circular in cross-section, comprises an annular outer wall 52, a spaced apart annular inner wall 54 and a channel 56 located between the outer and inner walls 52, 54. A disc receiving surface 58 may extend about the front or roll facing side or edge of the annular inner wall 54, approximately perpendicularly thereto, which is configured to engage a rear or laterally outboard facing surface of the disc 50 when the roll lockout system 20 is assembled as disclosed further below. Additionally, and still referring to FIG. 1, the seat 48 of the adapter 24 also includes a plurality of resilient catch fingers 60 that are annularly disposed about a rearward facing edge of the outer wall 52, and which are configured to deflect while passing through and as to be frictionally retained within the receiving slots 46 that are annularly disposed about the perimeter of the adapter receiving area 42. That is to say, after passing the respective resilient catch fingers 60 through the corresponding respective slots 46, an outwardly direct barb 62 on the end of each finger 60 prevents disengagement of the seat 48 of the adapter 24 from the adapter receiving area 42. In this configuration the seat 48 is releasably affixed to the front or roll facing surface of the adapter receiving area 42 of the roll support arm 22 while simultaneously inhibiting rotation of the seat 48 relative to the respective support arm 22.

Still referring to FIGS. 1-8, and primarily FIG. 1, the disc 50 that is configured to be received at the mating disc 50 will now described in further detail. The disc 50 comprises a width extending between a roll facing or front surface 64 and an opposing or laterally outboard facing or a rear surface 66. An outer rim 68 of disc 50 extends about perimeter of the disc 50 in a rearward direction. A mounting ring 70 is disposed toward the roll facing or front surface 64 of the disc 50, generally at a position between the outer rim 68 and a center of the disc 50. The mounting ring 70 includes a plurality of spaced apart deflectable mounting tabs 72 that each extend from a first interior end 74 that is affixed to the disc 50 to a cantilevered or free opposing second end 76 that is moveable relative to the disc 50, such that the tabs 72 may be flexed or resiliently depressed. The mounting tabs 72, which are radially spaced about the circumference of the mounting ring 70 and are interspersed by a plurality of core insert flange mating surfaces 78, extend generally in a radially outboard or rearward direction a distance behind the rear surface 66 of the disc 50.

Figure 2:
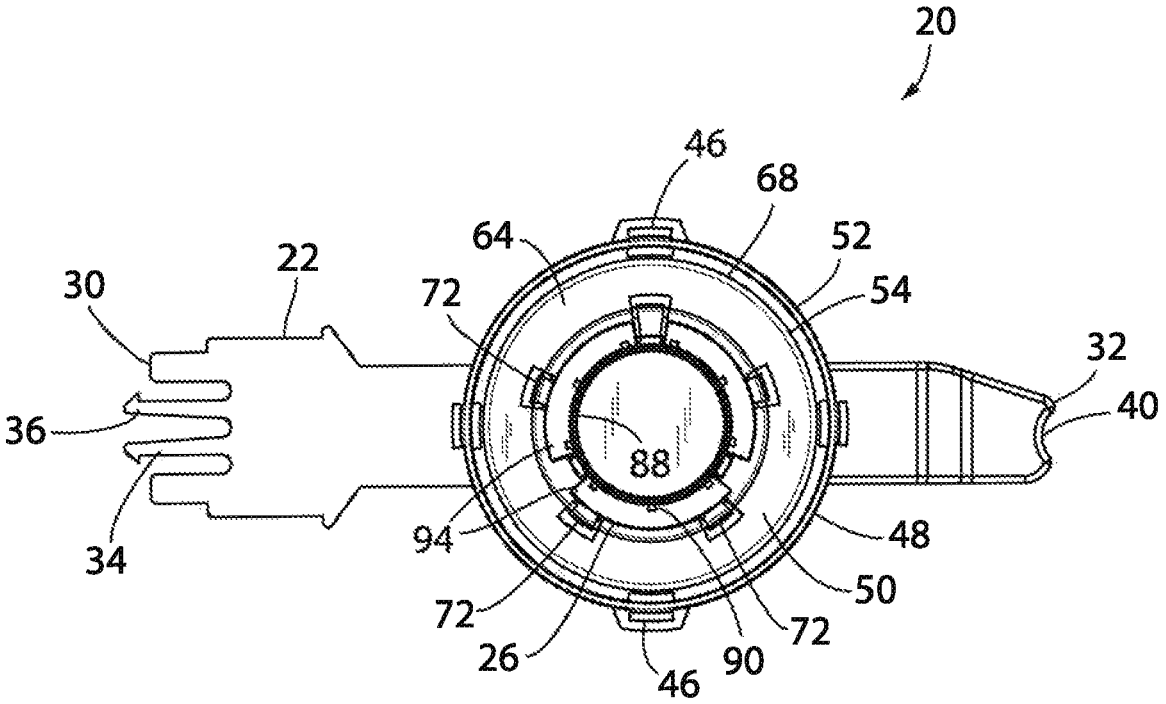
FIG. 2 is a roll facing elevation view of the assembled lockout system shown in FIG. 1.
Figure 3:
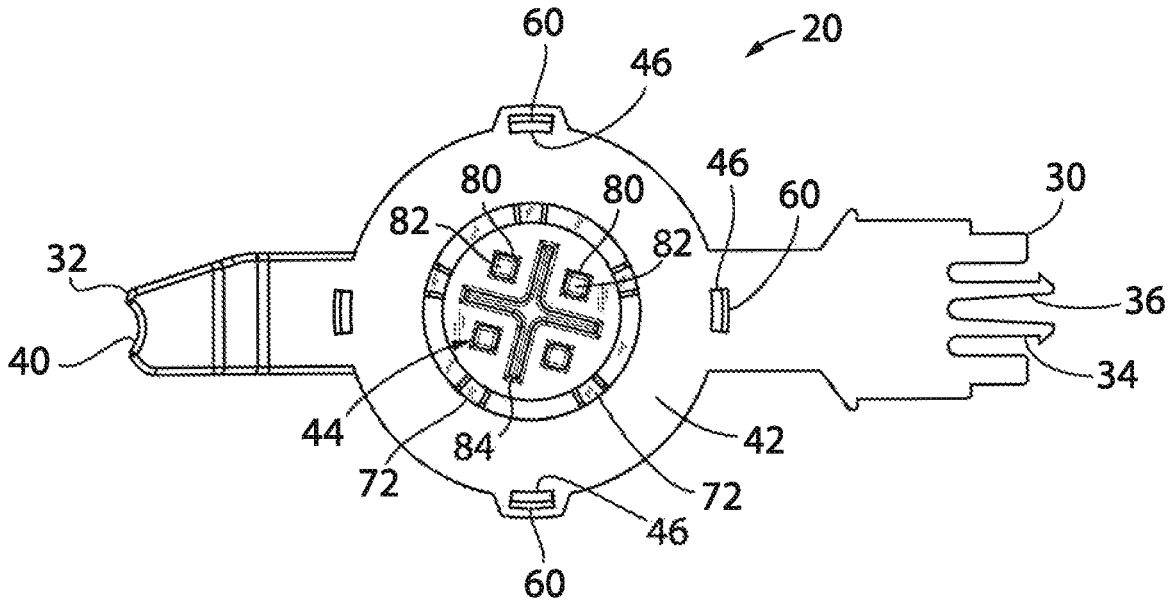
FIG. 3 is a laterally outboard side facing elevation view of the assembled lockout system shown in FIG. 1.
Figure 4:
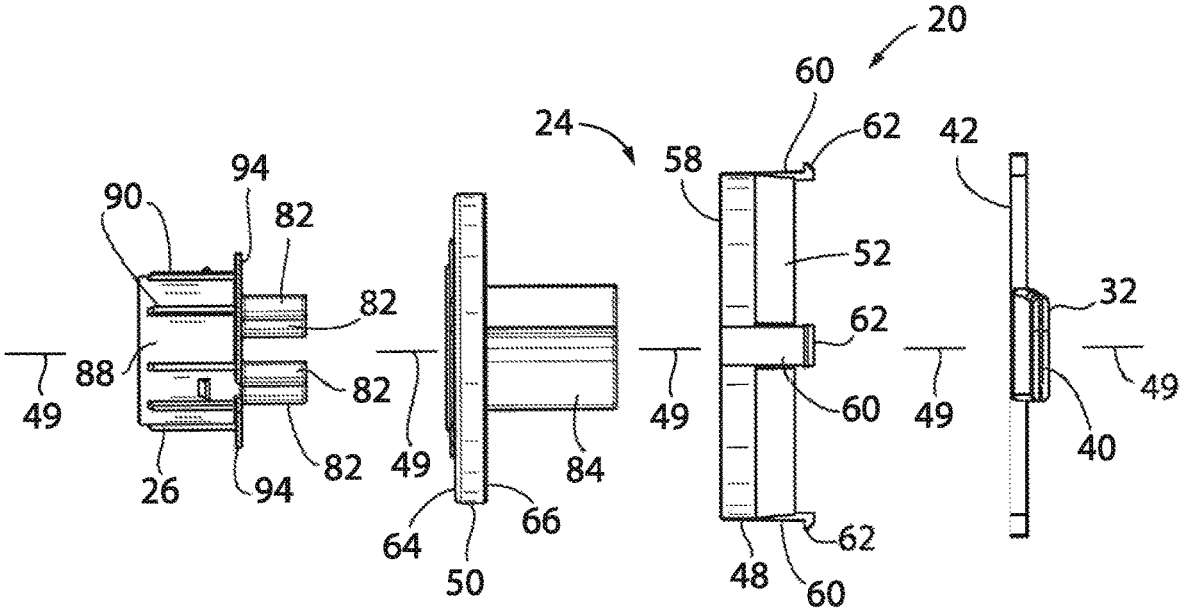
FIG. 4 is a front side exploded elevation view of the lockout system shown in FIG. 1.
Figure 5:
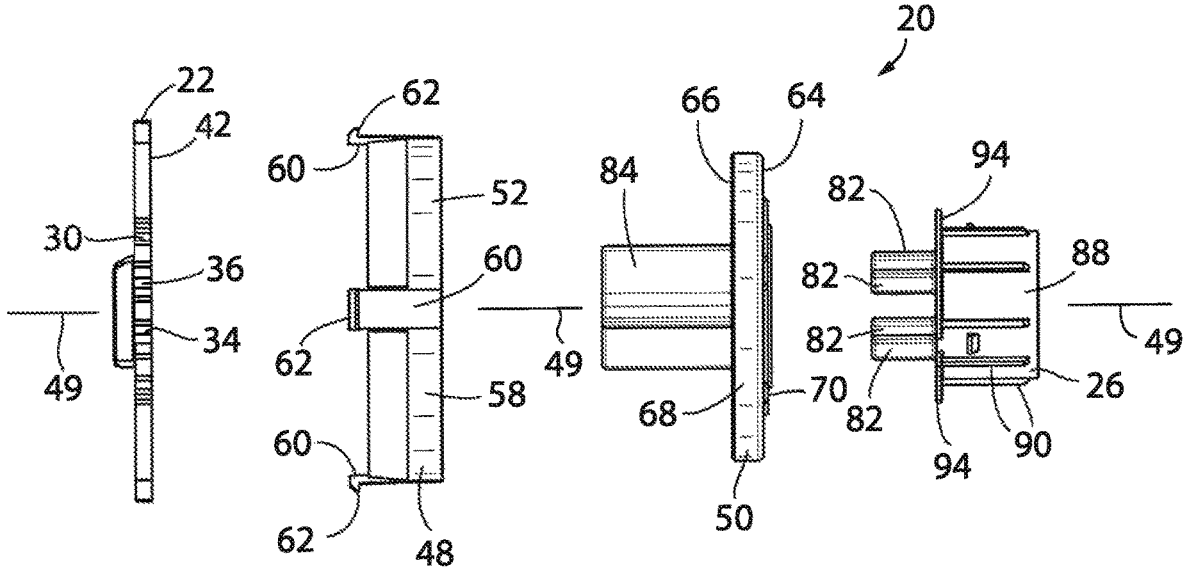
FIG. 5 is a rear side exploded elevation view of the lockout system shown in FIG. 1.
Figure 6:
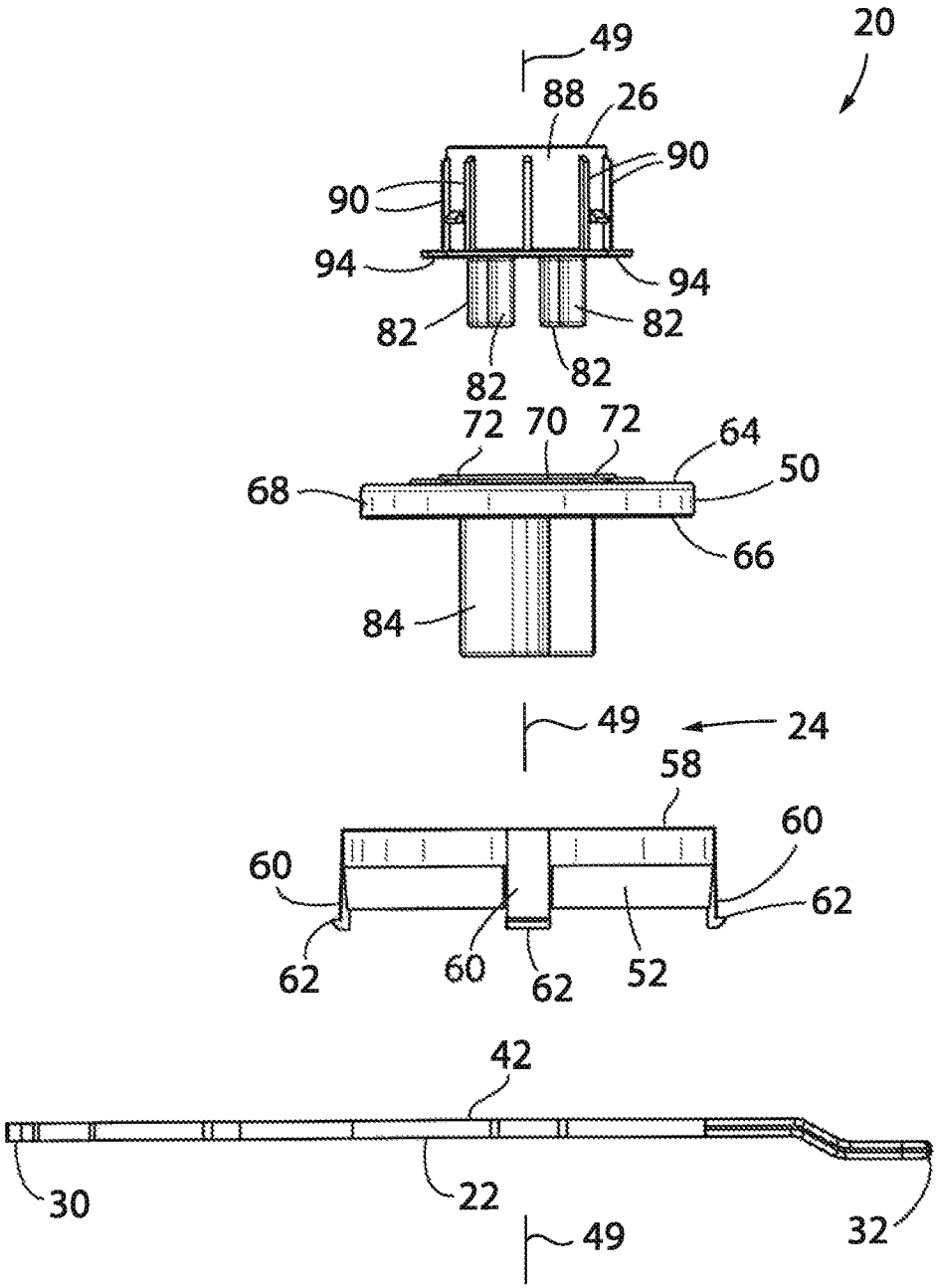
FIG. 6 is a top plan exploded view of the lockout system shown in FIG. 1.
Figure 7:
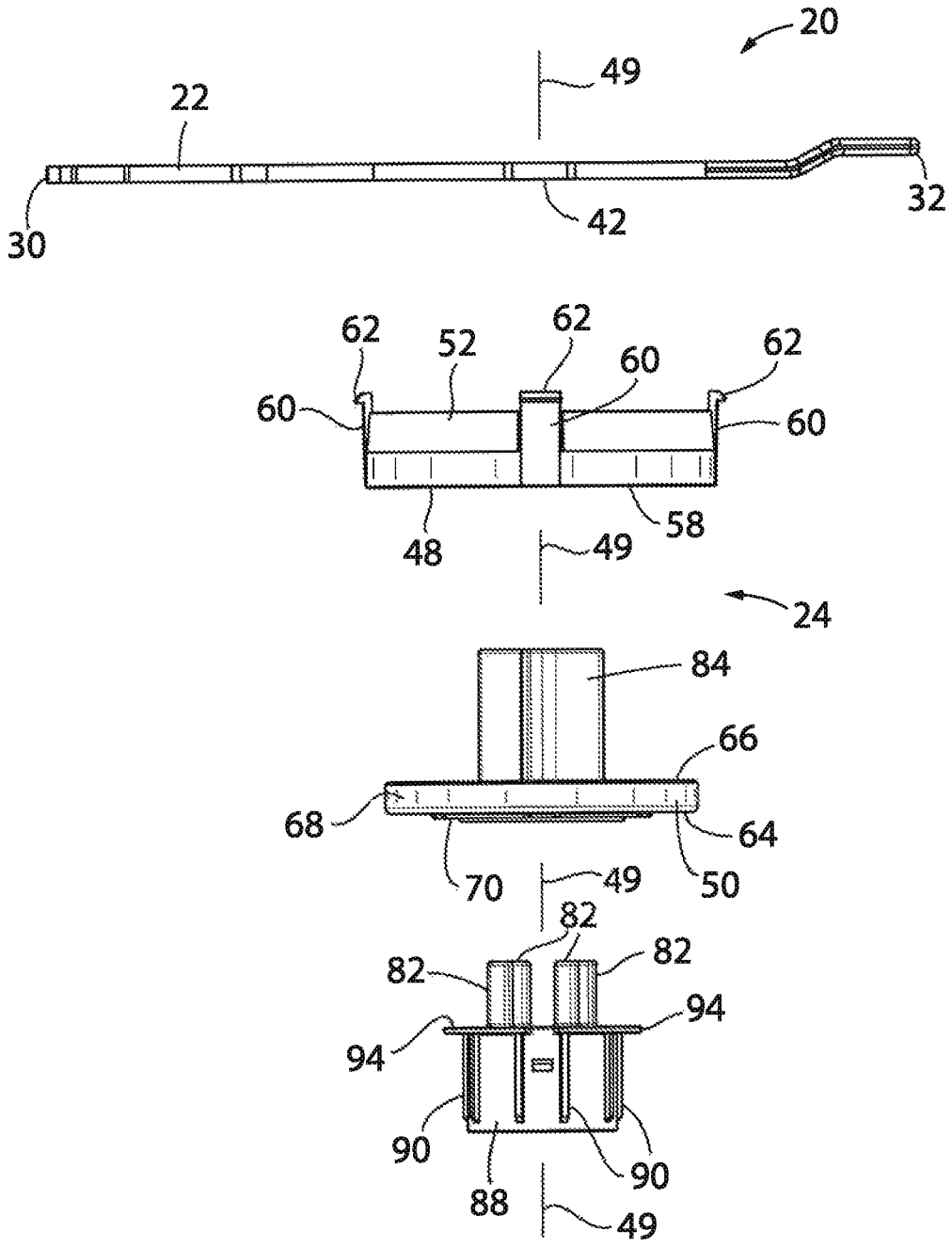
FIG. 7 is a bottom plan exploded view of the lockout system of FIG. 1.
Figure 8:
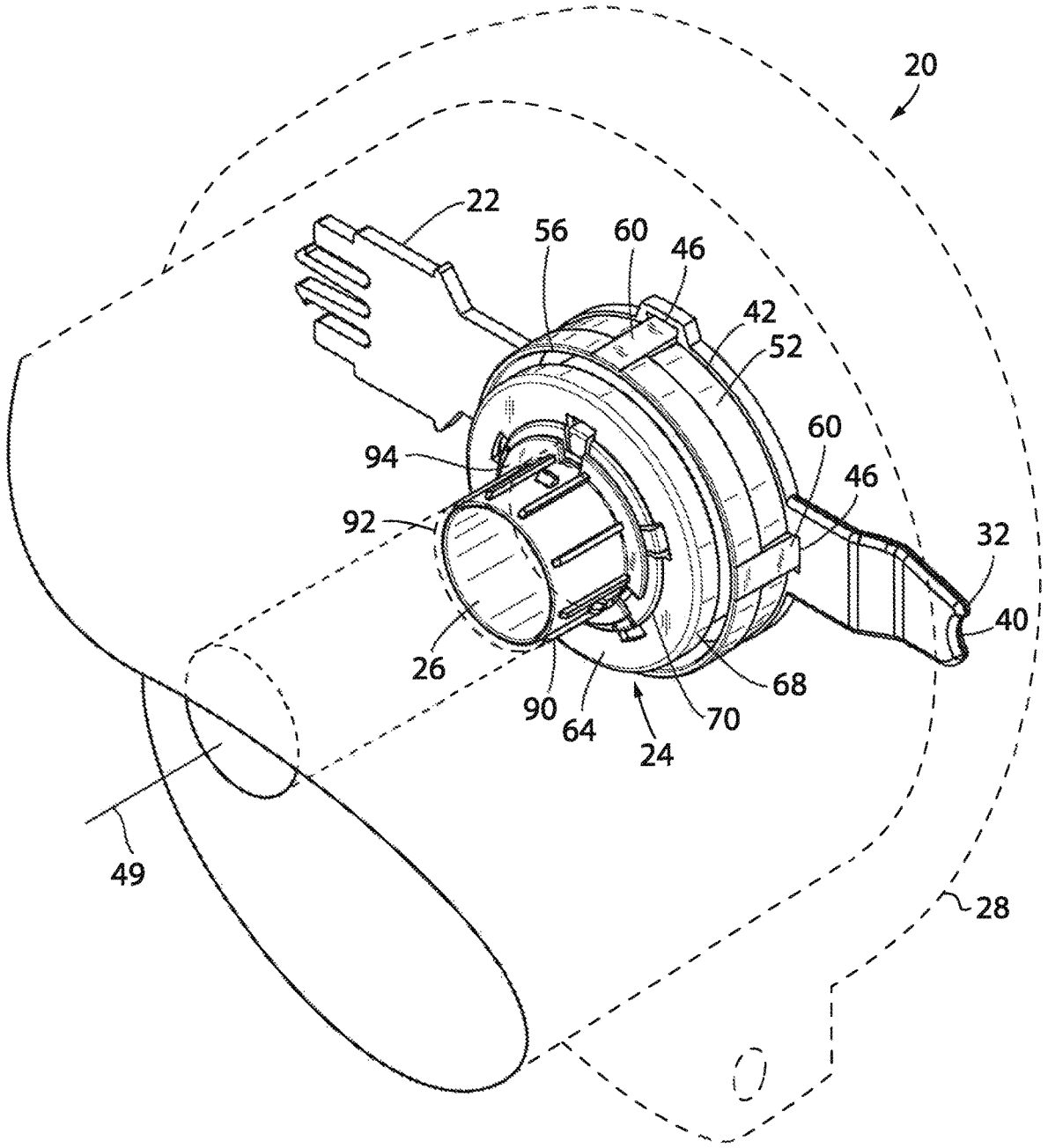
FIG. 8 is a front perspective view of the assembled lockout system of FIG. 1 with a phantom roll of authorized web material associated therewith.

As shown in FIGS. 2, 3, and 8, when the roll lockout system 20 is assembled, the disc 50 cooperates with seat 48 such that disc 50 is rotatable relative thereto. More specifically, the outer rim 68 of the disc 50 is received within the channel 56 of the seat 48 and the rear surface 66 of the disc 50 is pressed rearward into contact with the disc receiving surface 58 until the second end 76 of each of the mounting tabs 72 deflects in an inward radial direction such that continued axial translation of the disc 50 in the rearward or outboard axial direction allows each mounting tab 72 to deflect over and subsequently engage the rearward or axially outboard facing surface of the disc receiving surface 58. In such an orientation, the disc 50 is affixed to the seat 48 such that disc 50 is rotatable relative to seat 48 but is secured in an axial location relative to seat 48 and thereby relative to arm 22. Preferably, tabs 72 are configured to snap-fittingly cooperate with the radially inward directed edge of surface 58 in response to an outward axial translation of disc 50 toward seat 48 during assembly of roll lockout system 20.

Returning now to FIG. 1, mounting ring 70 includes one or more of a plurality of indexing or registration elements, i.e., registration slots 80 associated with an interior area of the mounting ring 70 and which are generally positioned about the center of the disc 50. As shown in the exemplary embodiment of FIG. 1, the registration slots 80 may include four slots, each having a generally square cross-sectional area. However, it is appreciated that registration slots 80 according to the present invention could be provided in virtually any number, shape or position relative to mounting ring 70. Any number, shape or position of registration slots 80 are considered within the scope of the appending claims. The registration slots 80 are sized, shaped and positioned to selectively removeably cooperate with corresponding projections or registration posts 82 that extend in an outboard lateral or axial oriented direction from a rear surface of the core insert 26 in a selectively axially associable and rotational mating configuration as will be described in further detail below.

Disc 50 includes a plurality of walls that collectively define a handle 84 that extends in the outboard axial direction relative to rear surface 66 of the disc 50 and towards the void 44 in the adapter receiving area 42 of the roll support arm 22. The handle 84 improves the structural rigidity of disc 50 and may be engaged by a user during loading operation to rotate the disc 50 into a desired position such that registration slots 80 are generally axially aligned with respective registration posts 82 of core insert 26 associated with a roll of web material to simplify the aligning of the registration slots 80 with their mating posts 82 extending from the core insert 26 during dispenser loading operations.

The core insert 26 is configured to be disposed within the hollow core of a roll of web material 86, as shown briefly in FIG. 8. Preferably, core inserts 26 are constructed to be disposed in the hollow area of a roll of web material, whether provided in a cored or coreless configuration and wherein the discrete inserts 26 are not otherwise removable or replaceable relative to discrete rolls of web material without destruction of the discrete core insert. Returning now to FIG. 1, the core insert 26 includes an annular wall 88 having plurality of radially aligned retention barbs 90 extending in a radially outward direction from the outer surface of the annular wall 88. The retention barbs 90 are configured to frictionally engage the core 92 or hollow bore of a roll of web material and improve retention of the core insert 26 within the core 92 of the roll of web material 86.

As alluded to above, core insert 26 is preferably non-removable from a hollow bore or core of a roll of web material without destruction of the core insert 26. To further improve proper positioning of the core insert 26 within the roll core 92, an outer flange 94 extends in an outward radial annular direction about the axially outboard or support facing or rear edge of the wall 88. In use, the outer flange 94 abuts a sidewall associated with the axial end of the roll of web material 86 and prevents the core insert 26 from being placed too deep within the bore or core 92 of the discrete roll of web material during the manufacturing process.

As seen in FIG. 8, the outer flange 94 preferably abuts the core insert flange mating surfaces 78 of the mounting ring 70 on the disc 50, when the roll lockout system 20 is assembled and configured for the supported roll of web material and sequential rotational dispensing operation. The rotational interaction between disc 50 and outer wall 52 or adapter 24 is configured to cooperate with the roll of authorized web material and each other such that, during the dispense operation, the frictional interaction between disc 50 and outer wall 52 prevents over-rotation of adapter 24 and the roll of web material associated therewith relative to dispenser assembly 28 whether the dispense assembly is provided in a manually operable configuration or a powered or touchless dispensing configuration. Such a consideration ensures the repeatable operation of dispenser assembly 28 for the entirety of each discrete authorized roll of web material associated therewith and through consumption of multiple discrete rolls.

Additionally, as was previously described a plurality of registration posts 82 extend in an outboard axial direction from core insert 26 and relative to a roll of web material engaged therewith and are received within the registration slots 80 in a male/female configuration. It is appreciated that the relative orientation of the mail/female engagement interface could be reverse of that shown. That is, it is appreciated that disc 50 could constructed to include a respective male or projecting structure and core insert 26 could be constructed to include a corresponding female or receding or cavity structure configured to slideably receive the corresponding projecting structure to allow a selective axial slideable interaction and cooperating rotational interaction therebetween. It is further appreciated that although posts 82 are each shown as extending in an axial direction that is generally aligned with, albeit offset from, axis 49 and oriented to extend along respective axis that are parallel to axis 49, other orientations of the plurality of projections or posts 82 are envisioned.

Regardless of the specific projection/cavity configuration and/or orientation employed between a respective core insert 26 and corresponding mating disc 50, lockout system 20 is configured such that only rolls of web material 86 that contain a core insert 26 with the proper registration posts 82 size, shape, number, and spacing to mate with the corresponding registration slots 80 of the mating disc 50 will be properly received by the dispenser 28 equipped with a roll lockout system 20 according to the present invention. It is further appreciated lockout system 20 could be provided in a configuration wherein the respective insert, or cooperating disc, could be configured to cooperate with a limited number or group of inserts or discs rather than one insert or disc configuration. Furthermore, in addition to providing mating with the registration slots 80, the registration posts 82 also provide the physical support for core insert 26 and its surrounding roll of web material 86 to be releasably retained by the disc 50. That is to say, that by inserting the registration posts 82 into the registration slots 80, the core insert 26 becomes rotationally linked with the disc 50, such that the rotation of the roll of web material during the dispense operation causes rotation of core insert 26 and thereby rotation of mating disc 50 via communication of the rotational forces through the registration post and slot linkage.

Upon depletion of the roll of web material 86, the dispenser 28 may be opened and the remaining disposable core insert 26, and/or the roll core associated therewith but absent the web material 86, may be discarded or recycled, and a new roll of web material 86 equipped with only a corresponding core insert 26 may be engaged and supported by roll lockout system 20 to effectuate the desired continued and repeatable usage of dispenser assembly 28. It should be further appreciated that the generally planar roll racing surface associated with disc 50 mitigates the potential of user's configuring dispenser assembly 28 for use with rolled web material products that are not equipped with a suitable core insert 26 that is constructed to provide the physical and rotational support of a discrete roll of web material relative to the underlying dispenser assembly 28.

The generally planar or relatively deminimis extension of roll facing surface of disc 50 in the axial direction relative to the axis of rotation thereof provides a construction associated with the roll facing surface of disc 50 mitigates the ability of the user or owner of dispenser assembly 28 to load dispenser assembly 28 with rolled web material product that has not been previously authorized as being suitable for use with dispenser assembly 28. Further, the slideable cooperation of core insert 26 and mating disc 50 allows the user or service personnel to immediately confirm during service or reloading operations that a particular roll of web material is suitable for use with a particular dispenser assembly 28 via confirmation of the presence and appearance of core insert 26 as having a generally mirror image construction of mating disc 50. When deployed, lockout system 20 further allows service personnel to readily affirm whether an issue with a dispenser operation is attributable to dispenser operation or an attempt at use of the discrete dispenser assembly 28 to dispense rolled web material that is of insufficient character so as to have be authorized to be dispensed with the discrete dispenser assembly.

Figure 9:
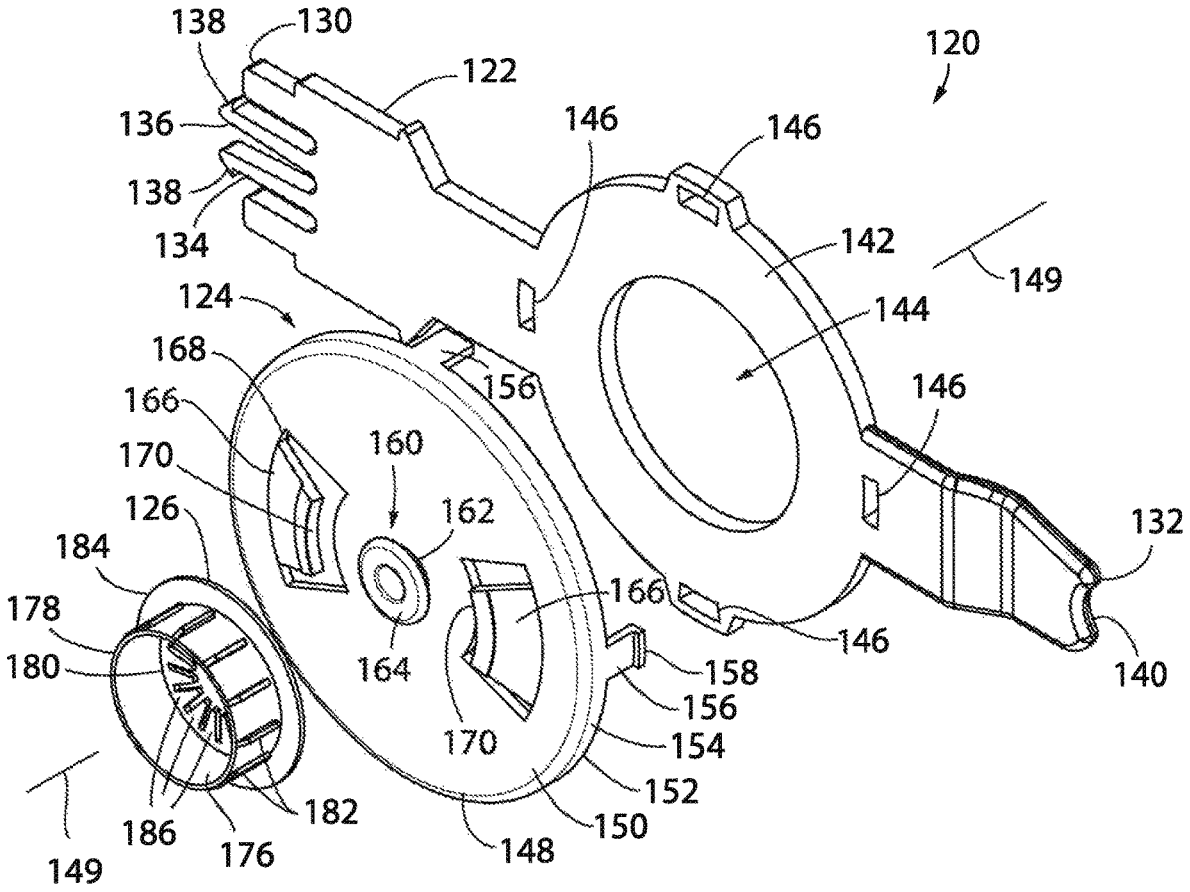
FIG. 9 is an exploded perspective view of a rolled web material lockout system for use in a rolled web material dispenser and according to an alternate embodiment of the present invention.
Figure 10:
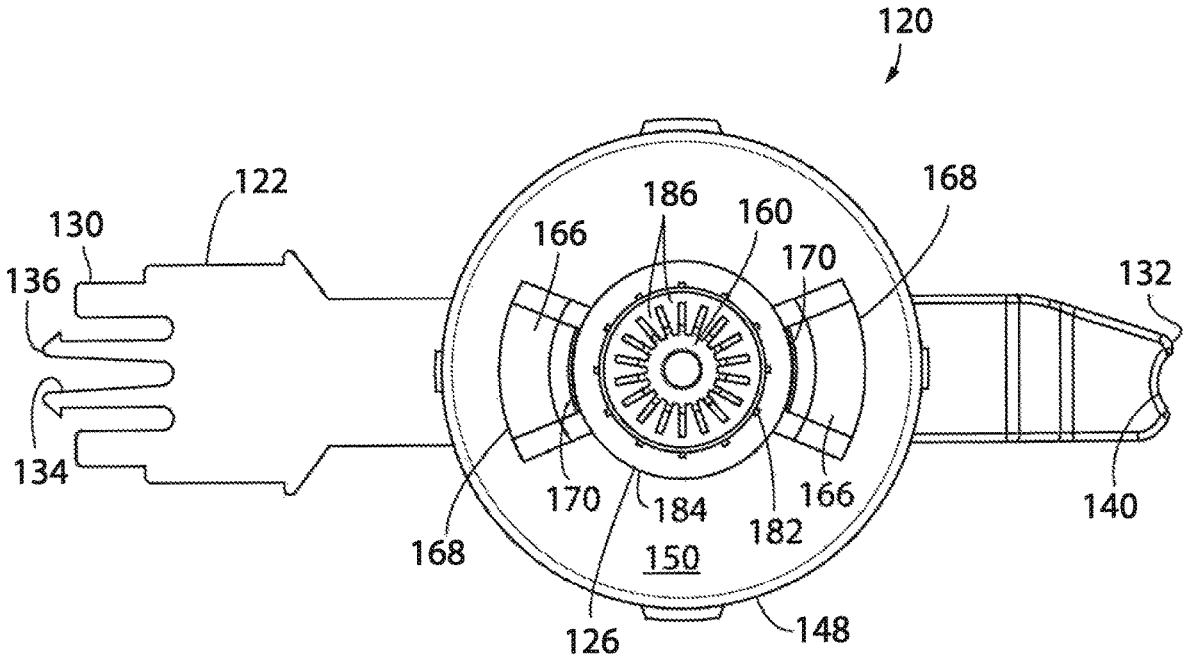
FIG. 10 is a roll facing side elevation view of the assembled lockout system shown in FIG. 9.
Figure 11:
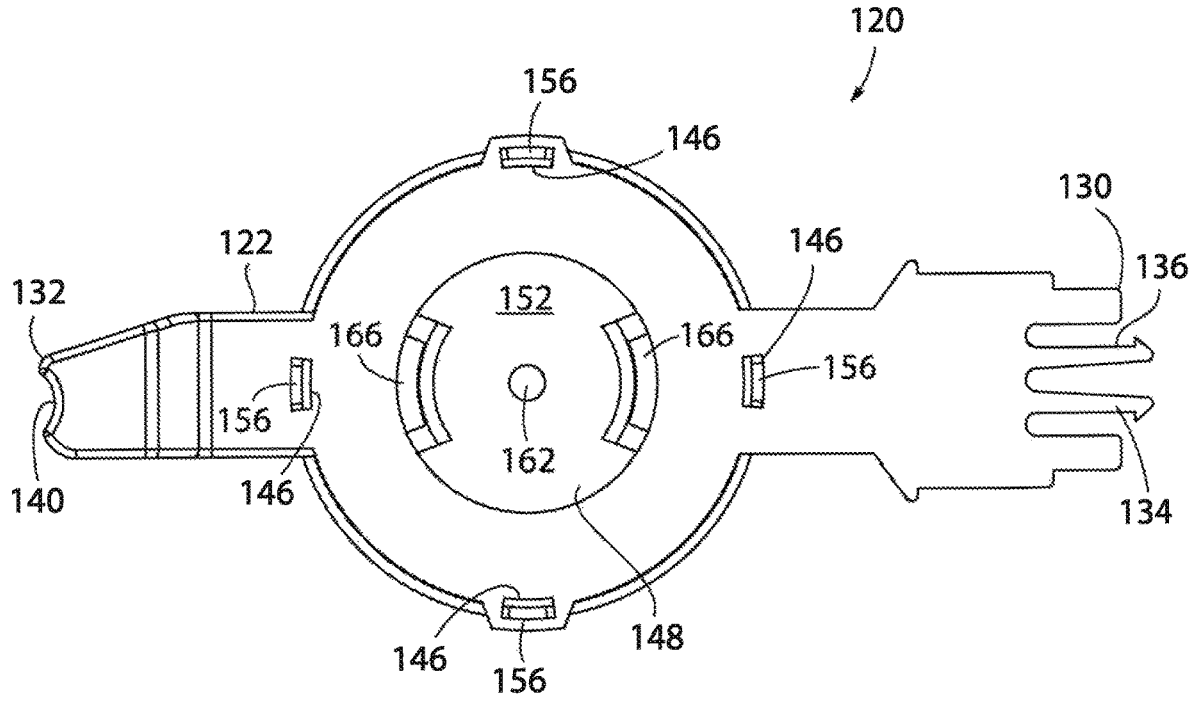
FIG. 11 is a laterally outboard side facing elevation view of the assembled lockout system shown in FIG. 9.
Figure 12:
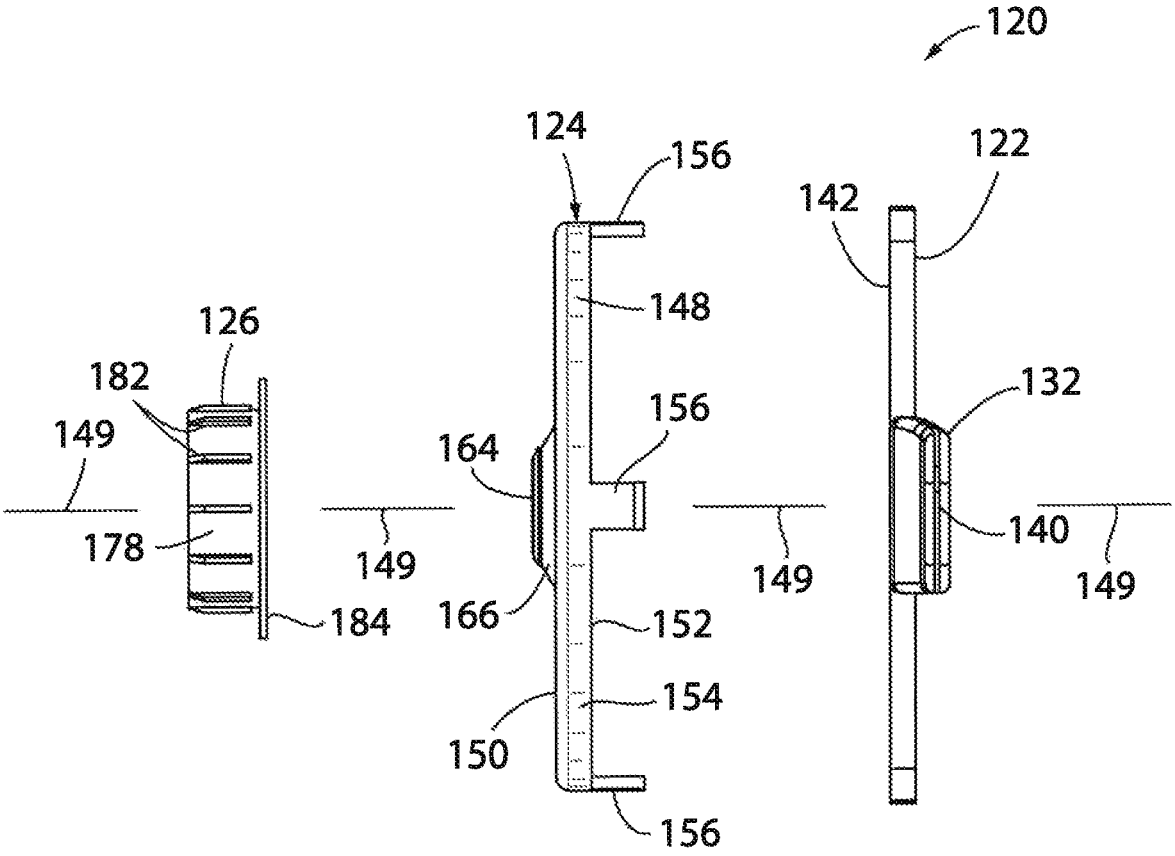
FIG. 12 is a front side exploded elevation view of the lockout system shown in FIG. 9.
Figure 13:
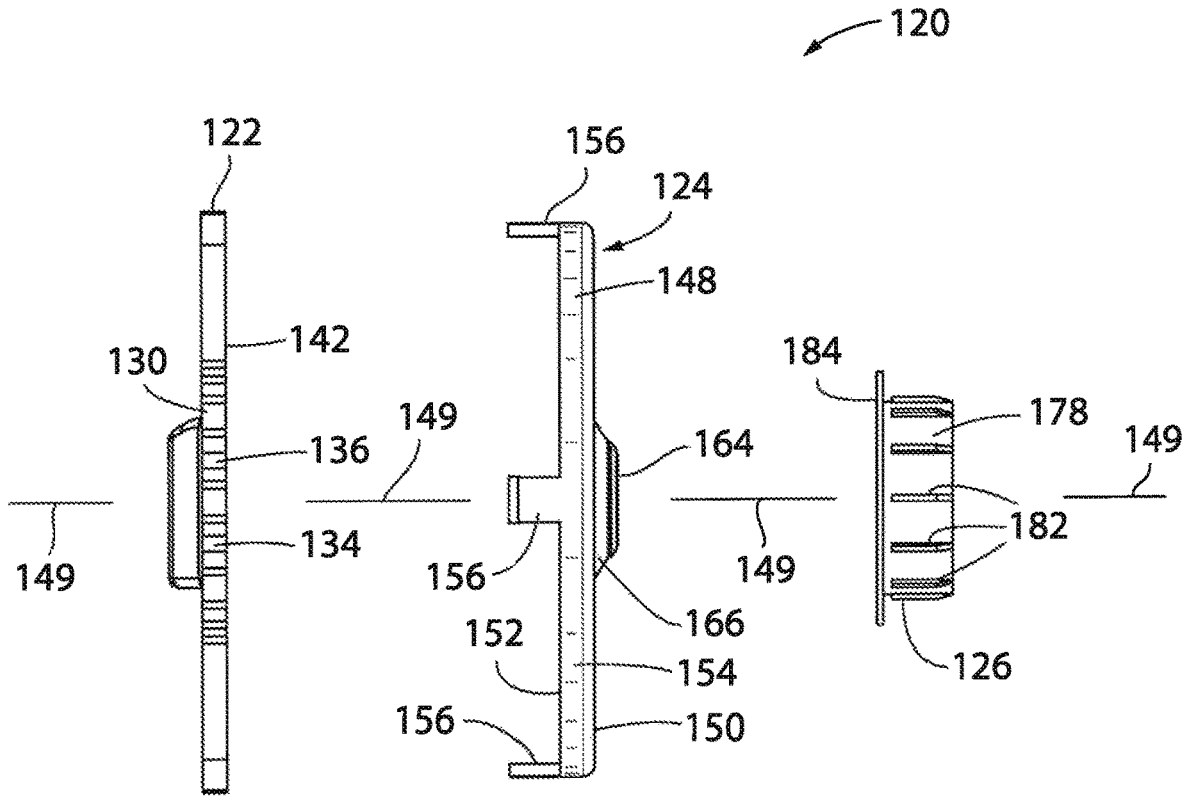
FIG. 13 is a rear side exploded elevation view of the lockout system shown in FIG. 9.
Figure 14:
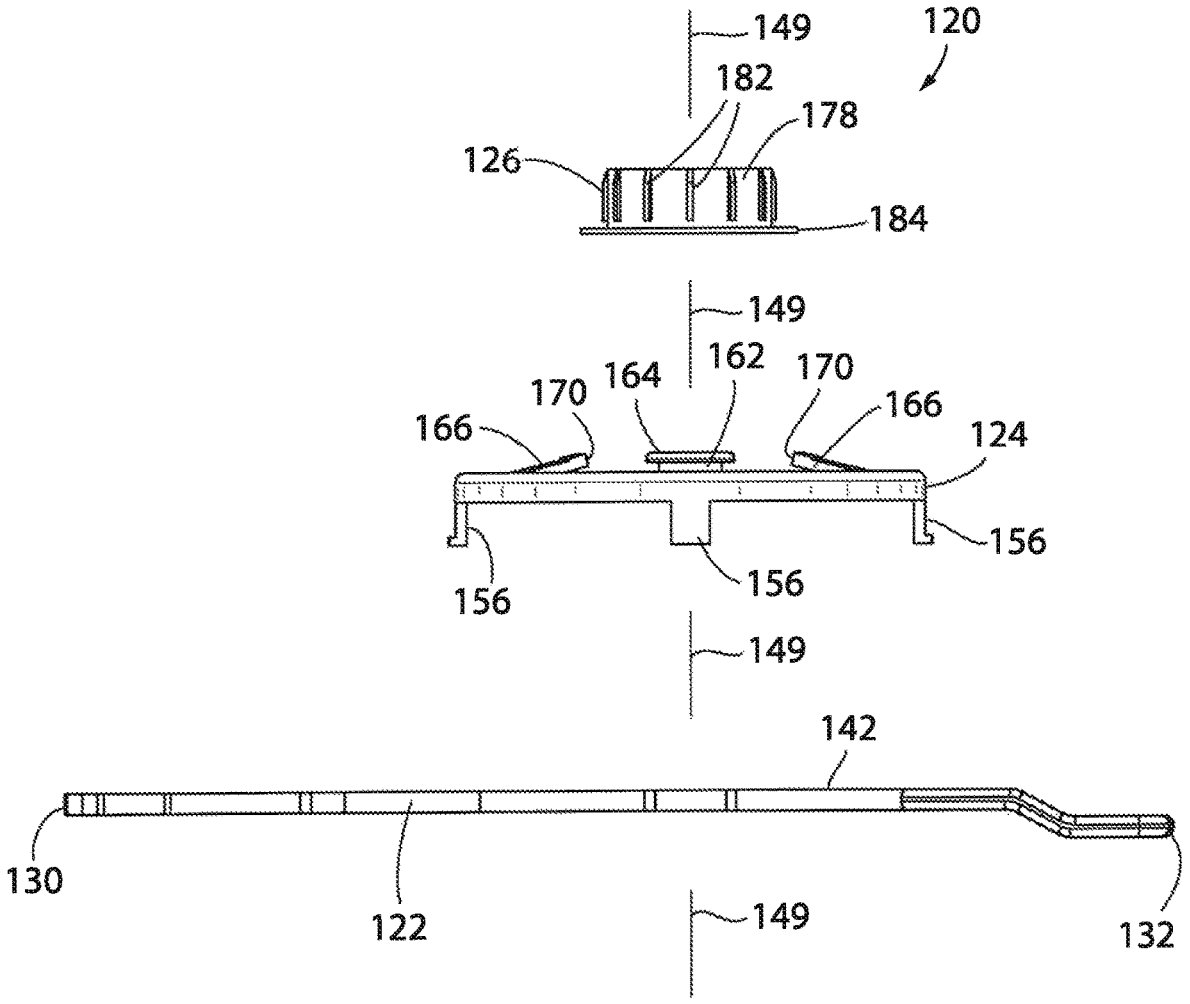
FIG. 14 is a top plan exploded view of the lockout system shown in FIG. 9.
Figure 15:
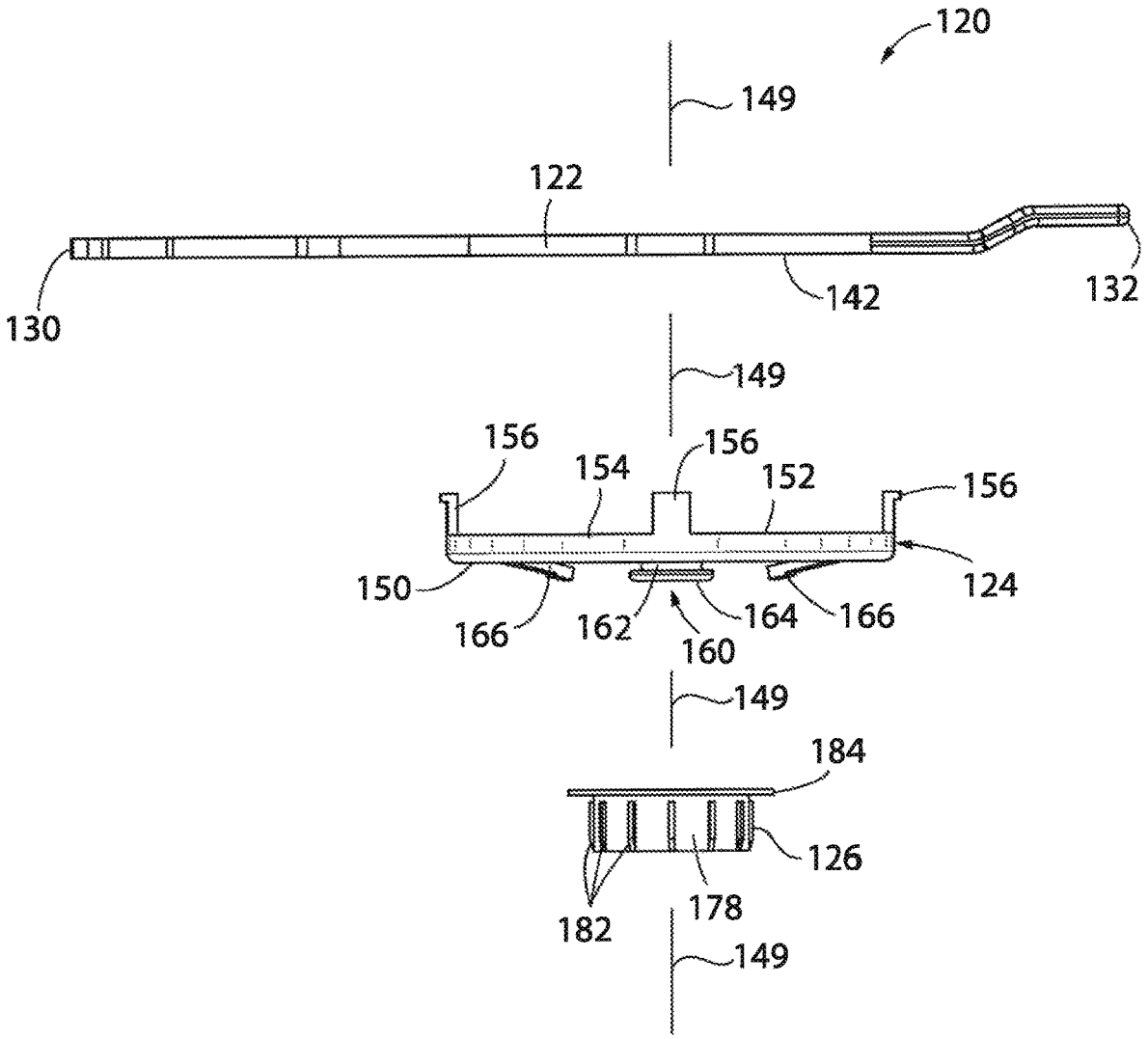
FIG. 15 is a bottom plan exploded view of the lockout system shown in FIG. 9.
Figure 16:
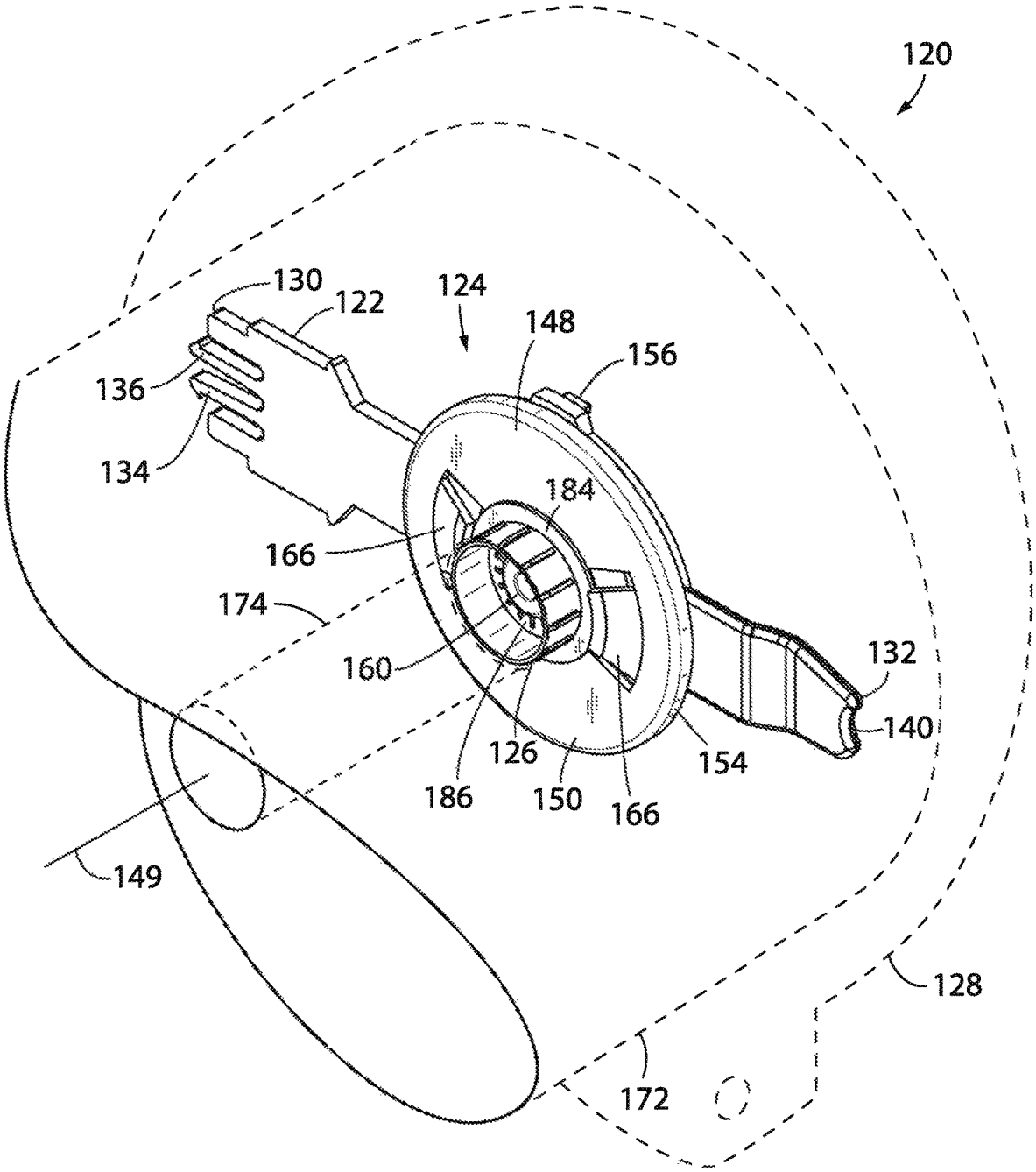
FIG. 16 is a front perspective view of the assembled lockout system shown in FIG. 9 with a phantom roll of authorized web material associated therewith.

Turning now to FIGS. 9-18, and initially FIG. 9, a roll lockout system 120 according to another embodiment of the invention is shown and will be described in further detail below. Roll lockout system 120 includes a roll support arm 122, an adapter 124 and a core insert 126 that extend along a longitudinal axis 149 that is coincident with the longitudinal axis of an authorized roll of web material associated therewith when the same is used to load a dispenser assembly. The roll support arm 122 of the roll lockout system 120 is generally similar to the structure of the roll support arm 22 as described above with respect to roll lockout system 20. Accordingly, the roll support arm 122 and parts thereof are identified by like reference number, which have been increased by a value of "100." That is to say, that the roll support arm 122 is configured to extend from a rear wall and into a roll supporting cavity of a rolled material dispenser assembly 128, as shown in FIG. 16. Like roll support arm 22, roll support arm 122 is constructed to snap-fittingly cooperate with the enclosure of dispenser assembly 128 and support one of the respective opposing ends of a roll of web material disposed therein.

Figure 17:
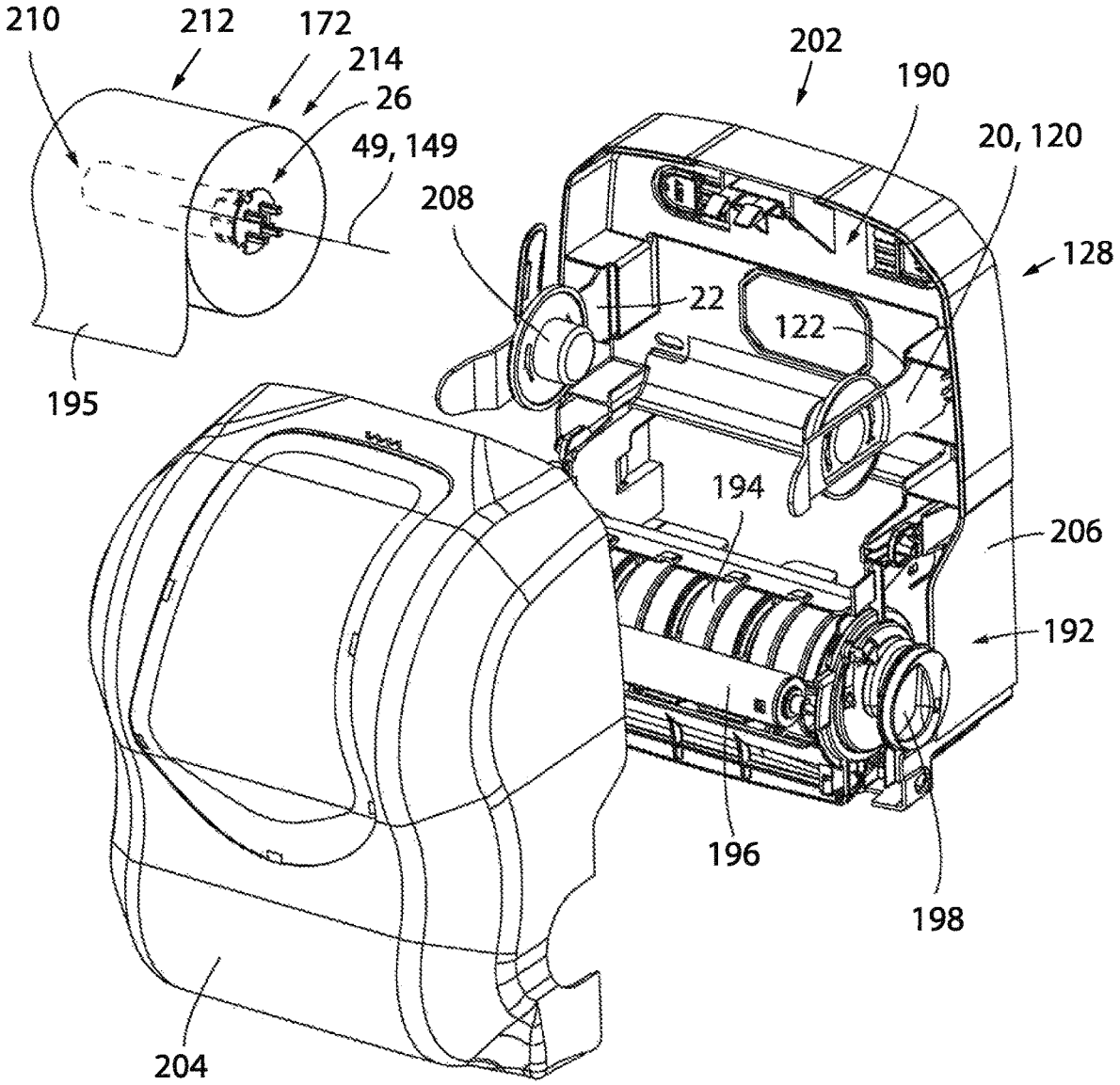
FIG. 17 is a perspective partially exploded view of a dispenser assembly equipped with the rolled material lock out system shown in FIGS. 1-8 and a roll of authorized web material associated therewith.

The roll support arm 122 extends along a length from a first end 130 to an opposing second end 132. The first end 130 of the roll support arm 122 includes a first and second resilient catch arm 134, 136, each of which contain opposing barbs 138 configured to releasably engage a receiving slot in the dispenser assembly 128 in a snap fit configuration. The opposing second end 132 of the roll support arm 122 has an optional arcuate depression that is configured to allow a user to deflect support arm 122 in an outboard or outward lateral or axial direction relative to a roll of web material, or a core of a previously dispensed roll of web material, to facilitate convenient and/or singled handed reloading operation of the dispenser assembly with a subsequent authorized roll of web material as disclosed further below. It is also appreciated that second end 132 of roll support arm 122 could be constructed to slideably cooperate with an interior facing surface of a cover of dispenser assembly as disclosed above with respect to lockout system 20 to allow the weight of the roll of web material carried by support arm 122 to be distributed over both ends 130, 132 of the roll support arm 122 rather than in a cantilevered orientation as shown in FIG. 17 and as disclosed further below. It is further appreciated that support arms 22, 122 are interchangeable relative to one another and interchangeable relative to the opposing ends of a roll of web material and dispenser assembly 28 as disclosed further below.

Like support arm 22, support arm 122 includes an adapter receiving surface or area 142 that is disposed along a portion of the length of the roll support arm 122 between the first and second ends 130, 132 thereof. As shown in FIG. 9, the adapter receiving area 142 in one embodiment of the present invention is generally circular having a hollow center or void 144 therein. However, it should be understood that the present invention is not so limited and that other configurations of the adapter receiving area 142 are considered within the scope of the present invention. Still referring to FIG. 9, the adapter receiving area 142 includes a plurality of receiving slots 146 that are annularly disposed generally proximate the perimeter of the adapter receiving area 142 for receiving and mating to the adapter 124 as described in further detail below.

The adapter 124 of the roll lockout system 120, differs from that of the roll lockout system 20, in that the adapter 124 is formed of a single integral component, e.g. disc 148. The disc 148 of the adapter 124 comprises a width extending between an axially inboard or roll facing, or a front surface 150 and an axial outboard or away from a roll facing or a rear surface 152. The outer perimeter of the disc 148 is defined by an annular outer wall 154 that extends rearwardly towards the adapter receiving area 142 of the roll support arm 122. A plurality of resilient catch fingers 156 are annularly disposed about an axial outboard or a rear edge of the outer wall 154 and are configured to deflect while passing through and be frictionally retained within the receiving slots 146 that are annularly disposed about the perimeter of the adapter receiving area 142. That is to say that after passing the resilient catch fingers 156 through the slots 146, a radially outwardly directed barb 158 on the end of one or more of fingers 156 prevents inadvertent separation or disengagement of the disc 148 of the adapter 124 from the adapter receiving area 142 of roll support arm 122. In this configuration the disc 148 is releasably affixed to the front surface of the adapter receiving area 142 of the roll support arm 122 while simultaneously inhibiting rotation of the disc 148 relative thereto.

Still referring to FIG. 9, the disc 148 further comprises a centrally located hub 160 that extends in an axially inboard direction, roll facing direction, or forward direction relative to the roll facing or front surface 150 and generally about the central axis of the disc 148. As shown in FIGS. 14 and 15, the hub 160 comprises a post 162 that extends from the front surface 150 of the disc 148 and has a generally circular retention cap 164, where the cap 164 has a radius greater than that of the post 162, formed at the distal free end of the hub 160. That is, the configuration of the roll facing surface 150 of disc 148, post 162, and cap 164 defines a substantially annular groove formed between the disc facing side of cap 164 and roll facing surface 150 of disc 148 and the radially outward directed surface of post 162. As described further below, the hub 160 is configured to engage the core insert 126 thereon such that core insert 126, and the authorized roll of web material associated therewith, is supported by disc 148 and rotatable relative thereto. Like disc 50, hub 160 of disc 148 extends in the axial direction a substantially deminimis distance such that hub 160 of disc 148 is insufficient to receive and securely retain a conventional roll of web material in the absence of a corresponding core insert 126 being associated therewith.

Referring briefly back to FIG. 9, the disc 148 may further comprise one or more optional deflectable braking tabs 166 disposed within the disc 148 between the hub 160 and the outer wall 154. The braking tabs 166 generally comprise a first end 168 affixed to the disc 148 and an opposing second end 170 that is independent of the disc 148 such that the second end 170 may flex or deflect upon the application of an axially directed force being applied thereon. As further shown in FIG. 9, the second end 170 of each braking tab 166 extends forward of the front surface 150 of the disc 148. In this configuration, the second end 170 of each braking tab 166 may frictionally engage the lateral edge or respective axial end of a discrete roll of web material 172 during use of the roll lockout system 120 and exert a drag or braking force on the movement of the authorized roll of web material associated with the dispenser assembly and to thereby reduce incidence of free spinning of the roll of web material 172. As disclosed further below with respect to FIG. 17, such considerations maintain a taught configuration of the portion of the authorized web material that extends between the roll and the roller assembly associated with the dispense activity thereby providing a repeatable dispense activity for each actuation of the dispenser assembly throughout consumption of each discrete authorized roll of web material associated with the dispenser assembly.

Like core insert 26, core insert 126 is configured to be disposed within the hollow or a core 174 of each discrete roll of web material 172, as shown briefly in FIG. 16, that is authorized to be dispensed by a dispenser assembly equipped with lockout system 120. Returning now to FIG. 9, the core insert 126 according to the roll lockout system 120 includes an annular wall 176 extending between a roll facing or front edge 178 and an outboard facing or rear edge 180. A plurality of retention barbs 182 extend in an outward radial direction from the radially outer surface of the annular wall 176 and are configured to frictionally engage the core 174 of the authorized roll of web material 172 and increase retention of the core insert 126 within the core 174 or hollow center portion of the roll of web material. To further improve proper positioning of the core insert 126 within the roll core 174, an outer flange 184 extends annularly outward about the rear edge 180 of the wall 176. In use, the outer flange 184 abuts the radially extending respective end portion of the roll of web material 172 and prevents the core insert 126 from being placed too deep within the core 174 to accommodate operable supporting engagement of the core insert 126 with disc 148 as disclosed further below.

A plurality of projections or hub retention fingers 186 are disposed proximate flange 184 at the laterally outboard or rear edge 180 of the wall 176 of core insert 126. Each of the hub retention fingers 186 extends in generally radially inward projecting direction and are provided in a cantilevered orientation such that a distal or free end of each of the respective retention fingers 186 terminates short of a rotational axis or axis 149 of core insert 126. The retention fingers 186 are slightly flexible or deflectable relative to flange 184 in the axial direction 149 and allow the core insert 126, during use, to be pressed axially outboard or in an axial direction away from the roll of web material associated therewith until, as seen in FIG. 16, the outer flange 184 abuts the roll facing or forward surface 150 of the disc 148, and the hub retention fingers 186 deflect over the cap 164 of the hub 160, and are retained in the groove defined between the cap 164, the roll facing or front surface 150 of the disc 148, and the radially outward facing surface of post 162.

It should be appreciated that unlike projections 82 of insert 26, projections or retention fingers 186 extend in a generally radial direction rather than axial direction. It should be further appreciated that fingers 186 are oriented to achieve a frustoconical, of having the shape of a fustrum of a cone, shape when the fingers 186 are engaged with hub 160 of adapter 124 such that fingers 186 can achieve an orientation of deflective over the outermost radial diameter of hub 160 and engage groove defined by post 162 of hub 160 during engagement and removal of insert 126 therewith. It should be further appreciated the plurality of projections 82, 186 defined by each of inserts 26, 126 are oriented radially inboard relative to an outermost radial dimension of each of respective inserts 26, 126 and are oriented to cooperate with a radially interior location of the corresponding adapter 24, 124. Such considerations provide a compact engagement interface between the respective insert 26, 126 and the corresponding adapter 24, 124 such that a respective dispenser can be quickly and conveniently configured for operation with a desired one of lockout systems 20, 120.

Accordingly, only rolls of web material 172 having a core insert 126 that includes retention fingers 186 that are properly sized and spaced relative to one another to accommodate engaging the cap 164 of the hub 160 therein will be properly received by the dispenser or dispenser assembly 128 comprising a roll lockout system 120 according to the second non-limiting embodiment of the present invention and in a manner that will facilitate incremental dispensing of the authorized roll of web material. Furthermore, in addition to providing mating between the retention fingers 186 and the hub 160, the fingers 186 and hub 160 also provide the rotational physical support for core insert 126 and its surrounding roll of web material 172 to be releasably retained by the disc 148.

As shown in FIG. 17, during implementation, or upon depletion of the roll of web material 172, the cavity 190 of dispenser assembly 128 may be exposed to allow the user access thereto. Dispenser assembly 128 includes a feed mechanism 192 that is constructed to cooperate with a free end 195 of roll of web material 172 to effectuate each dispense activity. Feed mechanism 192 includes a number of rollers 194, 196 that are constructed to effectuate the dispense activity and thereby unwind the roll of web material 172 during each dispense action. Dispenser assembly 128 includes a handle 198 that is operational to effectuate manual operation of one or more of rollers 194, 196 to effectuate the dispense activity. Although configured to accommodate manual dispensing operation, it is appreciated that dispenser assembly 128 could be provided to operate in an automatic or touchless manner via the inclusion of various proximity sensors and drive systems configured to actuation operation of rollers 194, 196 in response to the proximity of a user, or user's hand, relative to a throat or dispense opening 200 of dispenser assembly 128 when in the ready for use configuration or with other manual actuation assemblies such as manually operable lever arms, push paddles, or the like.

Still referring to FIG. 17, dispenser assembly 128 includes a housing 202 that is generally defined by a cover 204 that movably or pivotably cooperates with a base 206 such that opening of housing 202 of dispenser assembly 128 exposes cavity 190 associated with accepting an authorized roll of web material 172. As shown in FIG. 17, dispenser assembly 128 preferably includes at least two support arms 22, 122 that are disposed on generally opposite lateral sides of cavity 190. One of support arms 22, 122 includes a bobbin or a boss 208 that is shaped to cooperate with a bore or hollow cavity 210 of a coreless roll of web material 172 of indiscriminate source. It is appreciated that the axially oriented cavity 210 of the discrete rolls of web material can be defined by a cigarette of the roll of material, a cardboard or other rigid material core tube upon which the web paper material is wound, or other methodologies commonly employed in the web paper roll material forming processes to create the hollow bore associated with the roll of web material. Regardless of the methodology employed, boss 208 is shaped to rotationally support a roll of web material from a majority of sources of rolled web material. The other of support arms 22, 122 of dispenser assembly 128 is provided with a respective one of material lockout systems 20, 120.

In the embodiment shown in FIG. 17, it can be appreciated that support arm 22, 122 includes lockout system 20 as authorized roll of web material 172 includes core insert 26. It should be appreciated that dispenser assembly 128 can be readily configured to operate with either of lockout systems 20, 120 via the replacement of the respective lockout enabled support arm 22, 122 and/or engagement of the other of adapters 24, 124 with a discrete respective support arm 22, 122. It is further appreciated that, although dispenser assembly 128 is shown as being equipped with one lockout system 20, 120 associated with a respective one of lateral or axial ends 212, 214 of authorized roll of web material 172, dispenser assembly 128 could be configured to include a pair of lockout systems 20, a pair of lockout systems 120, or a respective one of each of lockout systems 20, 120 being associated with a respective one of support arms 22, 122.

It is further appreciated that one of lockout systems 20, 120 can be configured to cooperate with only one of the respective axial ends 212, 214 of authorized rolls of web material 172 and in a manner wherein the "overhand" (as shown in FIG. 17) or "underhand" unwinding orientation of the authorized roll of web material relative to dispenser assembly 128 creates a desired presentation of the free end 195 of the authorized roll of web material 172 at feed mechanism 192 to effectuate the desired continual sequential dispensing of the web material. After an authorized roll of web material 172 has been fully dispensed or otherwise depleted, housing 202 can be opened and the remaining disposable insert 26, 126, absent its respective supply of rolled web material 172, may be removed from the respective corresponding adapter 24, 124 and subsequently discarded and/or recycled, and a new authorized roll of web material 172 with a respective core insert 26, 126 orientation and construction in accordance with the respective one or more of support arms 22, 122 to provide the operative cooperation with the respective adapter 24, 124 can be associated with underlying dispenser assembly 128 for continued use thereof. Whether provided with one or more of, or mixed relations of, roll lockout systems 20, 120, dispenser assembly 128 can be expeditiously configured to allow operability of the dispenser assembly 128 to dispense only material from rolls of web material that have been previously designated as acceptable for use with the respective dispenser assembly 128.

It is appreciated that various features and aspects disclosed in the present application may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. It is recognized that modifications may be made by one of skill in the art of the invention without departing from the spirit or intent of the invention and, therefore, the invention is to be taken as including all reasonable equivalents to the subject matter of the claims.

What is claimed is:

1. A web material roll lockout system for use in a dispenser assembly comprising:

an insert configured to be secured to a roll of web material proximate a longitudinal axis of the roll of web material, the insert comprising a first registration element that is oriented radially inboard of a radial perimeter of the insert, extends in a direction that is aligned with the longitudinal axis of the roll of web material, and comprises a plurality of spaced apart projections; and an adapter constructed to be supported by a dispenser housing and removeably cooperate with the insert to support the roll of web material such that the roll of web material is rotatable relative to the dispenser housing, the adapter defining a second registration element that removeably cooperates with the first registration element when the insert is engaged with the adapter and so that the insert is rotationally fixed relative to a roll of web material and is one of rotational relative to the adapter during rotation of the roll of web material and configured to effectuate rotation of the adapter during rotation of the insert.

2. The web material roll lockout system of claim 1 wherein the plurality of spaced apart projections extend in a direction that is generally parallel to an axis of rotation of the insert.

3. The web material roll lockout system of claim 2 wherein the second registration element comprises a plurality of slots in the adapter wherein each respective slot is configured to receive at least one of the plurality of spaced apart projections associated with the insert when the roll of web material is associated with the dispenser assembly.

4. The web material roll lockout system of claim 1 wherein the plurality of spaced apart projections extend in a direction that is nearer to perpendicular to an axis of rotation of the insert than parallel to the axis of rotation of the insert.

5. The web material roll lockout system of claim 4 wherein the plurality of spaced apart projections of the first registration element defined by the insert are each radially aligned within the insert and define a centrally located void between the spaced apart projections.

6. The web material roll lockout system of claim 5 wherein the second registration element of the adapter comprises a hub that is configured to be received within the centrally located void of the first registration element such that a distal end of each of the spaced apart projections are captured in a groove defined by the hub when the roll of web material is engaged with the dispenser housing.

7. The web material roll lockout system of claim 6 wherein the hub has a maximum outer diameter that is greater than a diameter of the centrally located void defined between the spaced apart projections of the insert.

8. The web material roll lockout system of claim 1 wherein an angular position of the adapter is fixed relative to the dispenser.

9. The web material roll lockout system of claim 1 wherein the adapter further comprises at least one projection that engages a lateral edge of the roll web material roll to inhibit rotation thereof.

10. The web material roll lockout system of claim 1 wherein the adapter further comprises a seat affixed in a stationary orientation to the dispenser housing and a disc that is disposed between the seat and the insert, is rotatable relative to the seat, and that defines the second registration element shaped to removeably cooperate with the first registration element of the insert.

11. The web material roll lockout system of claim 1 wherein an outer surface of the insert further comprises at least one radially disposed barb that is configured to frictionally engage a bore facing surface of the roll of web material.

12. A web material roll lockout system comprising:

a housing shaped to accommodate a roll of web material;

a support arm disposed within an interior of the housing;

an adapter constructed to cooperate with the roll support arm; and an insert constructed to be disposed within a bore defined by a roll of web material and removeably cooperate with the adapter to support a respective end of the roll of web material relative to the housing, the insert having a plurality of projections that define a first engagement interface that removeably cooperates with a second engagement interface defined by the adapter.

13. The web material roll lockout system of claim 12 wherein the plurality of projections one of 1) each extend in a radially inward directed frustoconically oriented cantilevered manner to define a free end of each respective projection that is oriented to cooperate with the second engagement interface of the adapter, and 2) each extend in an axial direction that is parallel to the bore defined by the roll of web material and are oriented at locations that are radially offset from a center axis of the bore defined by the roll of web material and slideably cooperate with discrete openings formed by the second engagement interface defined by the adapter.

14. The web material roll lockout system of claim 12 wherein each of the plurality of projections are oriented to define an opening that requires deflection of at least one of the projections to allow the first engagement interface to engage the second engagement interface.

15. The web material roll lockout system of claim 12 wherein each of the plurality of projections are radially oriented and extend in a radial direction relative to an axis of rotation of the insert and define a centrally located void between the plurality of projections.

16. The web material roll lockout system of claim 15 wherein the second engagement interface of the adapter includes a hub configured to be received within the void, and wherein the hub has an outer radial diameter that is greater than a diameter of the void.

17. The web material roll lockout system of claim 12 further comprising a seat disposed between the adapter and the support arm and wherein the adapter is formed as a disc disposed between the insert and the seat and that defines the second engagement interface such that the disc rotates with the insert relative to the seat.

18. A method of limiting use of a rolled web material dispenser, the method comprising:

providing an insert having a plurality of projections that collectively define a first registration element and shaping the insert to be secured in a bore of a roll of web material wherein each of the plurality of projections extend at least in part in an axial direction beyond an end face of the roll of web material; and providing an adapter that is constructed to be secured to a dispenser housing and removeably cooperate with the insert and shaping the adapter to define a second registration element that axially cooperates with the first registration element such that the adapter supports the insert and the roll of web material is rotatable relative to the dispenser housing.

19. The method of claim 18, further comprising orienting the plurality of projections such that each of the plurality of projections are oriented in one of a radially extending orientation relative to an axis of the bore and extend in an axial direction that is offset from and aligned with the axis of the bore.

20. The method of claim 18 further comprising deflecting at least one of the plurality of projections in the axial direction facilitates engagement and disengagement between the first registration element and the second registration element.

21. A web material roll lockout system for use in a dispenser assembly comprising:

an insert configured to be secured to a roll of web material proximate a longitudinal axis of the roll of web material, the insert comprising a first registration element that is oriented radially inboard of a radial perimeter of the insert and extends in a direction that is aligned with the longitudinal axis of the roll of web material;

an adapter constructed to be supported by a dispenser housing and removeably cooperate with the insert to support the roll of web material such that the roll of web material is rotatable relative to the dispenser housing, the adapter defining a second registration element that removeably cooperates with the first registration element when the insert is engaged with the adapter and so that the insert is rotationally fixed relative to a roll of web material and is one of rotational relative to the adapter during rotation of the roll of web material and configured to effectuate rotation of the adapter during rotation of the insert; and wherein the adapter further comprises a seat that is affixed in a stationary orientation to the dispenser housing and a disc that is disposed between the seat and the insert, is rotatable relative to the seat, and that defines the second registration element shaped to removeably cooperate with the first registration element of the insert.

* * * * *